United States Patent [19]

Zimmern

[11] Patent Number: 4,475,877

[45] Date of Patent: Oct. 9, 1984

[54] GLOBOID WORM MACHINE WITH METAL RING IN BEARING HOUSING

[76] Inventor: Bernard Zimmern, 6 New St., East Norwalk, Conn. 06855

[21] Appl. No.: 457,215

[22] Filed: Jan. 11, 1983

[30] Foreign Application Priority Data

Jan. 14, 1982 [FR] France ..... 82 00499

[51] Int. Cl.[3] ..... F01C 1/24; F04C 27/00

[52] U.S. Cl. ..... 418/140; 418/195

[58] Field of Search ..... 418/195, 196, 197, 140–144; 277/53, 55, 56, 57

[56] References Cited

U.S. PATENT DOCUMENTS

| | | | |
|---|---|---|---|
| 3,133,695 | 5/1965 | Zimmern | 418/195 |
| 3,752,606 | 8/1973 | Zimmern | 418/195 |
| 4,148,494 | 4/1979 | Zelahy | 277/53 |

FOREIGN PATENT DOCUMENTS

| | | |
|---|---|---|
| 333803 | 5/1919 | Denmark . |
| 782350 | 5/1934 | France . |
| 1331998 | 5/1962 | France . |
| 323101 | 12/1928 | United Kindgom . |
| 1548390 | 8/1975 | United Kingdom . |
| 1555329 | 8/1975 | United Kingdom . |

*Primary Examiner*—Leonard E. Smith
*Assistant Examiner*—Jane E. Obee
*Attorney, Agent, or Firm*—Ziems, Walter & Shannon

[57] ABSTRACT

A device to ensure tightness without friction and thus as reduced as possible clearance at the high pressure end of the screw. At the high pressure side of the screw, the bearing housing of the screw comprises a metal ring which is different from the metal of the screw ring and has a higher coefficient of expansion. This ring fills up a circular recess machined at the end of the screw. This device ensures an almost perfect leak-tightness in the case of compressors, or oil free expansion machines or high pressure pumps.

8 Claims, 4 Drawing Figures

GLOBOID WORM MACHINE WITH METAL RING IN BEARING HOUSING

It is known to achieve compressors, pumps or expansion machines especially of the type described in French Pat. No. 1 331 998, comprising a cylindrical screw provided with threads cooperating with one or preferably two symmetrical pinion-wheels, the teeth of which sweep the threads making with them compression or expansion chambers.

In those volumetric machines, the efficiency depends mainly upon the way used to ensure the leak-tightness of the screw on its end which is in contact with the high pressure, and this is particularly true with compressors which do not rely upon an auxiliary oil injection intended to achieve this leak-tightness. The economical interest consists precisely in the suppression of said oil injection and its attached impediments. Indeed, it appears that the said high pressure end is, on almost the whole periphery of the screw, in contact with pressurized gas and therefore that this area is one of the longest leakage lines of the machine.

To precise the orders of magnitude, with screws of a 140 to 240 mm diameter corresponding to swept volumes of approximately 2500 to 14000 liters per minute at a rotating speed of approximately 3000 rpm, the usual clearances of approximately 0.1 to 0.15 mm on the high pressure end permit to obtain through said clearances leaks of less than 1% of the swept volume when the compressor is provided with an oil injection and compresses air from 0 to 7 bars.

Contrarily, when operating without oil injection, for example by compressing refrigerant R 22 and injecting liquid refrigerant in the compression chamber in order to eliminate the compression heat, the same above mentioned clearances produce leaks of more than 5% of the delivery. To make them acceptable and of approximately 1% or less, clearances less than 30 microns and preferably of the order of 10 to 15 microns are to be reached in use.

BRIEF DESCRIPTION OF THE DRAWINGS

A volumetric machine of known type and a number of embodiments of the volumetric machine in accordance with the present invention are illustrated in the accompanying drawings which are given by way of example without any limitation being implied, and in which.

DETAILED DESCRIPTION OF THE PRIOR ART

Figure 1:
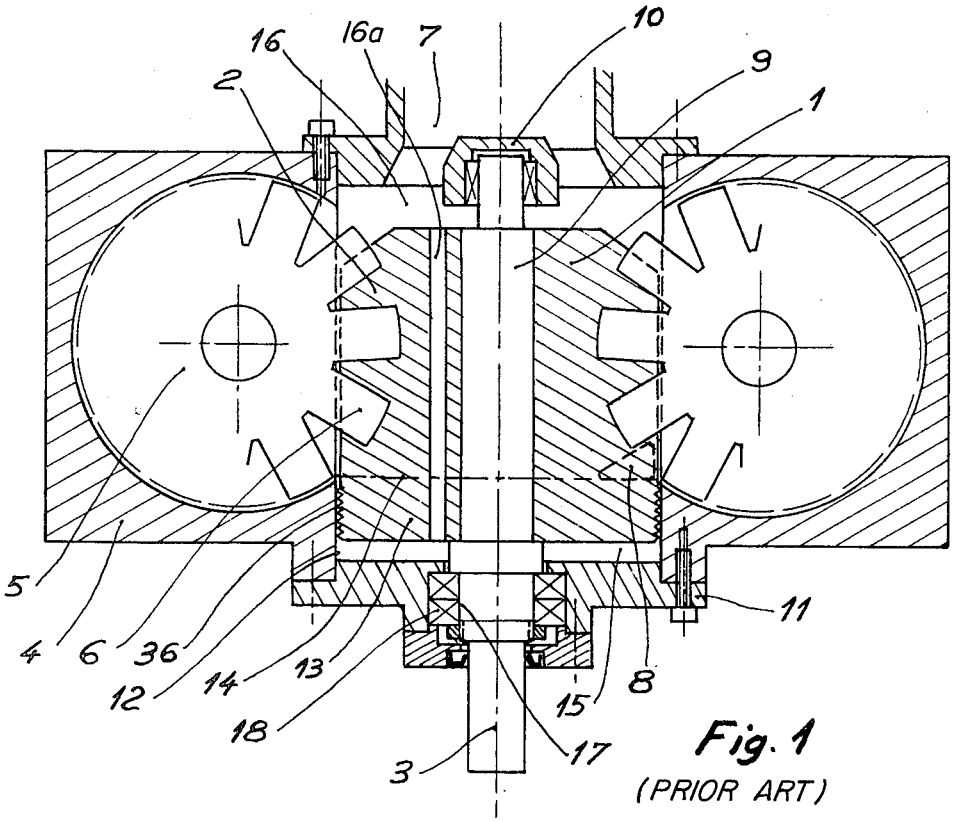
Fig. 1 (PRIOR ART)
FIG. 1 is a sectional view along the axis of the screw and along the plane of the pinion wheel of a known compressor, pump or expansion machine.

FIG. 1 shows a sealing device in accordance with French Pat. No. 1,331,998 and making it possible to reach approximately a 0.1 to 0.15 clearance and comprising a screw 1 provided with threads 2 and rotating about an axis 3. The screw 1 is mounted inside a casing 4 and is in mesh with two symmetrical pinion-wheels 5 provided with teeth 6. The casing is provided with a low pressure port 7 and a high pressure port 8—appearing in dotted lines because placed on the upper half of the casing which has been removed—placed in the vicinity of each pinion-wheel.

The screw is supported by a shaft 9 rotating inside bearing-housings 10 and 11, respectively situated on the low pressure side—or intake side in the case of a compressor—and on the high pressure side—or exhaust-side in the case of a compressor.

The bearing-housings are usually centered inside the bore 12 of the casing. As disclosed in French Pat. No. 1 331 998, the screw comprises, beyond a circle (dotted line 14) limiting the area of the threads on the high-pressure side, a solid part 13 which ensures leak-tightness between the end of the threads and a space 15 adjacent the high pressure end of the screw and connected with the intake 16 through channels such as 16*a*.

The solid part 13 may be advantageously provided with a labyrinth shown in 36, which improves the leak-tightness.

With this embodiment, it is nevertheless difficult to provide radial clearances smaller than 1/10 mm between the labyrinth 36 and the bore 12. Most of the eccentricities of the labyrinth 36 with respect to the axis of the bearing housing 11 may be discarded by machining jointly the labyrinth 36 and the bearing surface 17 of the bearings 18 on the shaft 9, i.e. without removal from the machining spindle; or also by assembling the bearings 18 tight on their inside and outside ball-bearing cups. But it is difficult, without an expensive machining, to eliminate an assembling looseness between the bearing housing 11 and the bore 12, and said looseness, of an order of magnitude of at least 0.1 mm due to the size of the various concerned parts, results in an off-centering which can be of the same order.

Figure 2:
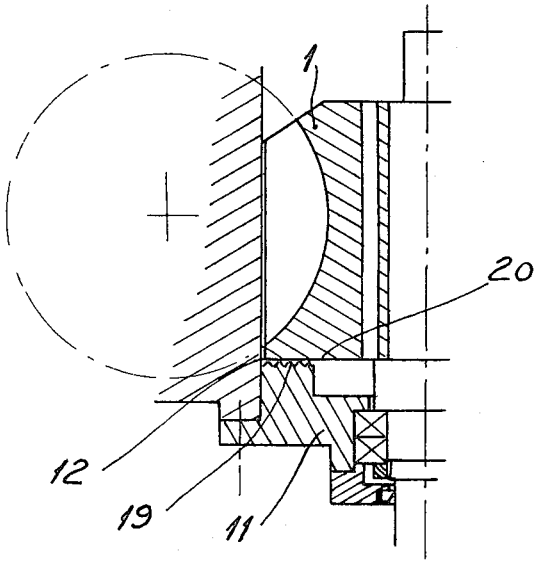
Fig. 2 (PRIOR ART)
FIG. 2 is a schematic sectional view of another prior art machine.

FIG. 2 shows a schematic sectional view, similar to FIG. 1, of an embodiment in accordance with British Pat. No. 1 548 390. In such embodiment, tightness is ensured by a plane and circular part 19, which is integral with the bearing housing 11 and may be provided with a labyrinth. Therefore, the high pressure tightness is ensured between said part 19 and the end 20 of the screw.

This solution has several advantages: it suppresses the problems of concentricity noticed as to the embodiment of FIG. 1; it permits the use of capacity control devices using slides such as described in British Pat. No. 1 555 329; finally, one can adjust at will the clearance between the face 20 and the labyrinth 19 when assembling.

The main disadvantage of this embodiment is that, in order to obtain an acceptable leak-tightness, the contact area between the faces 19 and 20 has to be extended rather close to the center of the screw, and that it leads to an axial thrust unacceptable for the bearings—since there is a pressure between the faces 19 and 20—notably in the refrigerating compressors, in which the exhaust pressures currently reach 15 to 25 bars.

The instant invention relates to an improvement to the volumetric machines of the type comprising a cylindrical screw which is provided with threads, is rotatably mounted inside a fixed casing and meshes with the teeth of at least one pinion-wheel, said casing being provided with at least one low pressure port and at least one high pressure port placed nearby the above-mentioned pinion-wheel, said screw comprising a shaft rotatably mounted in at least one bearing housing, said bearing housing being located in the casing close to the high pressure port, wherein according to the improvement, said bearing housing carries a ring made of a metal different from the metal of the screw, and with a higher coefficient of thermal expansion, said ring being provided with a bore surrounding with a very small clearance, a cylindrical protuberance continuing the screw beyond the area of the screw which comprises the threads. The invention permits to obtain easily the wanted clearances without the disadvantages of the above-mentioned solutions.

Indeed, this ring can be made out of a sleeve mounted on the bearing housing and perfectly concentric with it and therefore with the outer contour of the screw. Moreover, the ring being made of a different metal and of a metal with a higher coefficient of expansion than the screw, any possibility of seizing can be practically eliminated, on one hand because the metals are different, and on the other hand because, in case seizing begins the sleeve will expand faster than the screw. If the sleeve carries a labyrinth, a threading for instance this permits an extremely accurate adjustment. Moreover, this embodiment gives the possibility to reduce to small values, or even to cancel any axial thrust on the screw.

In a prefered embodiment, which especially allows the use of slides, the outer diameter of said ring is slightly smaller than the diameter of the casing bore in which the screw is rotatably mounted and the screw carries, on its high pressure end, beyond the area carrying the threads, an annular recess filled by the ring.

In this embodiment, there remains an axial thrust, because the sleeve ensures a frontal sealing as mentioned with respect to FIG. 2, but this thrust can be reduced because the sleeve can be thin, the major part of the leak-tightness occuring effectively between the inner wall of the ring and the adjacent wall of the recess.

DETAILED DESCRIPTION OF THE PREFERRED EMBODIMENTS

Figure 3:
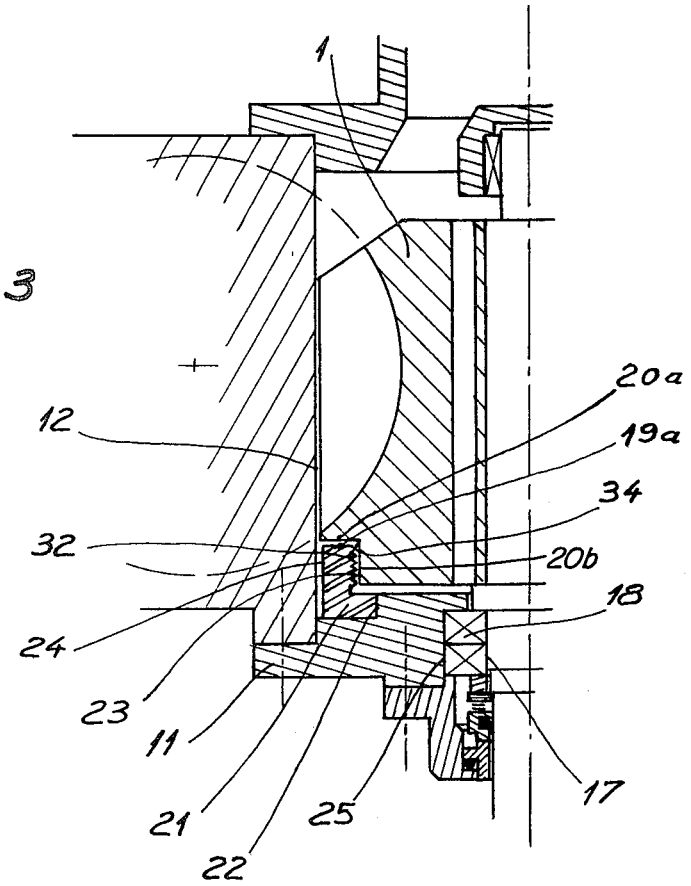
FIG. 3 is a schematic sectional view of a preferred embodiment according to the present invention.

As seen on FIG. 3, the bearing housing 11 carries a sleeve 21; the sleeve 21 has a bore 22 which is fitted without clearance by any process such as pressing or hot assembling on a cylindrical inner protrusion of the bearing housing 11. This sleeve comprises preferentially on its inner cylindrical wall a labyrinth 32 shaped for instance as a threading, the inner diameter 23 of the crests of the threading having at time of assembling a very slight clearance or even some tightness with respect to the cylindrical protuberance 34 of the screw. The plane annular end 19*a* of the ring 21 faces with a slight clearance a plane face 20*a* of an annular recess 20*b* machined in the screw around the protuberance 34 the cylindrical wall of which has a smaller diameter than the threaded area of the screw.

The diameter of the cylindrical outer wall 24 of the sleeve 21 is smaller than that of the bore 12 of the casing, the diametral clearance reaching as much as 0.1 to 0.2 mm. Moreover, the sleeve is made of a metal different from that of the screw and, having a higher coefficient of thermal expansion, for instance aluminium if the screw is of cast-iron.

A clearance, small though sufficient to prevent contact is left between faces 19*a* and 20*a* (which can besides, one or the other, be provided with a spiral, in order to limit the risks of seizing in case of accidental contact). If the labyrinth 32 contacts the protuberance 34, since the sleeve expands faster than the screw while the clearance left between the wall 24 and the bore 12 allows this expansion, the seizing that has started, is stopped. The clearance between the diameter 24 and the bore 12, although significant, has no practical consequence on the efficiency of the compressor as the gas under pressure cannot exit axially; it can only rotate around the sleeve so as to escape towards the threads of the screw where the pressure is smaller, but the section of this circular slot remains small and the distance to be covered by the gas along this circular slot is very long and thus this leak is negligible.

It will be noted that this embodiment allows, as well as the embodiment described in FIG. 2, the use of slides in accordance with British Pat. No. 1 555 329, but that unlike this patent, the axial thrust can be very low since the sleeve can be thin, the tightness between the faces 19*a* and 20*a* having only an effect similar to that of the clearance between the outer wall 24 and the bore 12, the major part of the tightness being actually ensured between the bore 23 and the cylindrical protuberance 34.

Finally, it will be noted that said bore 23 and said protuberance 34 can be perfectly concentric, subject only to the accuracy in concentricity of the bearings, insofar as the area of tightening 22 can, on the sleeve, be machined with the bore 23 and, on the bearing housing 11, with the bore 25 which centers the bearings.

Figure 4:
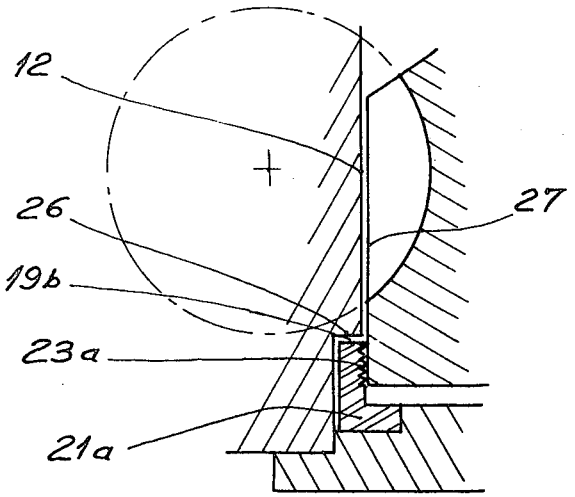
FIG. 4 is a partial sectional view of an alternate embodiment according to the present invention.

FIG. 4 shows an embodiment with a similar effect as in FIG. 3 except that said embodiment does not allow anymore the use of slides according to British Pat. No. 1 555 329. However, this embodiment suppresses any axial thrust. In said embodiment, the protuberance of the screw has the same diameter as the threaded area of the screw and the sleeve substantially fills up a recess made in the bore 12. There is a slight axial clearance, left between the front plane face 19*b* of the sleeve and a plane shoulder 26 of the recess. The sleeve is assembled with a very reduced clearance, or even tightly with the outer diameter 27 of the screw that has itself an important clearance of the order of 0.1 mm or even more with the bore 12 of the casing.

It will be noted that the previous embodiments described with cylindrical screws meshing with plane pinion-wheels can be applied, without changing the invention, to cylindrical screws in accordance with the French Pat. No. 1 586 832.

It will be noted also that although the machine has been described with two bearing housings 10 and 11 provided on each side of the screw, it is of course possible to use a single bearing housing 11, the screw being then cantilever mounted.

It will be noted finally that the ring 21 has been represented as being a sleeve set on the bearing housing 11; this can be the case if the casing, the screw and the bearing housing are all made out of cast-iron. But the ring can be integral with the bearing housing, if for instance said bearing housing because of the operating conditions, can be of a metal different from the screw and having a higher coefficient of expansion such as aluminium for example.

I claim:

1. A volumetric machine of the type comprising a cylindrical screw which is provided with threads, is rotatably mounted inside a fixed casing and meshes with the teeth of at least one pinion-wheel, said casing being provided with at least one low pressure port and at least one high pressure port placed nearby the above-mentioned pinion-wheel, said screw comprising a shaft rotatably mounted in at least one bearing housing, said bearing housing being located in the casing close to the high pressure port, wherein said bearing housing carries a ring made of a metal different from the metal of the screw and with a higher coefficient of thermal expansion, said ring being provided with a bore surrounding with a very small clearance , a cylindrical protuberance continuing the screw beyond the area of the screw which comprises the threads.

2. A volumetric machine according to claim 1, wherein the ring has an outer wall fitted with a certain annular clearance in a complementary wall of the housing.

3. A volumetric machine according to claim 1, wherein a labyrinth is provided on the wall of the ring which is adjacent the lateral wall of the protuberance.

4. A volumetric machine according to claim 3, wherein during mounting, the ring is tight around the protuberance.

5. A volumetric machine according to one of claims 1, 4, wherein the screw has at its high pressure end an annular recess surrounding the cylindrical protuberance, said recess being substantially filled by the ring of the bearing housing, the outer diameter of said ring presenting a small clearance with the bore of the casing in which the screw is rotatably mounted.

6. A volumetric machine according to claim 5, wherein the ring has a front wall which is directed away from the bearing and faces with a slight clearance a shoulder constituting one face of the recess of the screw.

7. A volumetric machine according to one of claims 1, 3, 4, or 5, wherein the cylindrical protuberance has the same diameter as the area of the screw which is provided with the threads, and wherein the ring substantially fills up an annular recess provided in the bore of the housing.

8. A volumetric machine according to claim 7, wherein the ring has a front wall which is directed away from the bearing and faces with a slight clearance a shoulder constituting one face of the recess of the casing.

* * * * *